US005876532A

United States Patent [19]

Billarant

[11] Patent Number: 5,876,532

[45] Date of Patent: Mar. 2, 1999

[54] METHOD FOR MANUFACTURING A LAMINATED ASSEMBLY COMPRISING A LAYER PROVIDED WITH LOOPS

[75] Inventor: Jean-Philippe Billarant, Paris, France

[73] Assignee: Aplix, Paris, France

[21] Appl. No.: 882,742

[22] Filed: Jun. 26, 1997

[51] Int. Cl.[6] ..... A61F 13/16; B32B 31/08

[52] U.S. Cl. ..... 156/66; 156/72; 156/289; 156/290; 156/324; 24/448

[58] Field of Search ..... 156/66, 72, 289, 156/290, 324; 428/100; 24/442, 448

[56] References Cited

U.S. PATENT DOCUMENTS

| | | |
|---|---|---|
| 4,743,330 | 5/1988 | Tillotson . |
| 4,994,054 | 2/1991 | Pigment et al. . |
| 5,605,729 | 2/1997 | Mody et al. . |

FOREIGN PATENT DOCUMENTS

| | | |
|---|---|---|
| 0 258 015 A2 | 3/1988 | European Pat. Off. . |
| 0 278 866 A1 | 8/1988 | European Pat. Off. . |
| 1 521 890 A | 4/1968 | France . |

*Primary Examiner*—Michael Ball
*Assistant Examiner*—Sam Chuan Yao
*Attorney, Agent, or Firm*—Adams Law Firm, P.A.

[57] ABSTRACT

A method for manufacturing a laminated assembly having a first layer with a face secured by an adhesive to a first face of a second layer having a meshed structure and having loops projecting from its second face. The method includes the step of depositing and adhering a thin film onto the first face of the second layer under controlled adhesive quantity and viscosity conditions so that the deposited film divides by itself to clear the mesh zones and to be converted into longitudinal and/or transverse beads.

9 Claims, 1 Drawing Sheet

METHOD FOR MANUFACTURING A LAMINATED ASSEMBLY COMPRISING A LAYER PROVIDED WITH LOOPS

TECHNICAL FIELD AND BACKGROUND OF THE INVENTION

The present invention relates to laminated or layered assemblies which include a first layer a face of which is secured by adhering to a first face of a second meshed layer. The second layer comprises a base with free loops projecting from a second face of said second layer.

The invention applies particularly to such assemblies which are flexible and which are used for making, for example in the form of bands, the female parts of so-called self-gripping fasteners, the loops of which are intended to engage,in a releasable hooting relationship, with complementary male elements, for example hooks, filiform elements with an enlarged head or the like. These female parts of self-gripping fasteners are used, among others, as adjustable and releasable closures for diapers.

For cost reasons one is led to manufacture the second layer base in a light and open meshed form, and therefore with a mechanically fragile and dimensionally unstable structure, without however sacrificing the quality of the loops which constitute the critical operative member of the self-gripping fastener female part. The fragility and instability of the base involves processing difficulties, which include, among others, positioning and securing at high speed this female part on its support. There are also utilization difficulties, due to relatively high tearing-out stresses to which the base is submitted and which result from the action of the male elements on the loops.

One is therefore led to reinforce the base by adhering it on a more resistant supporting layer, for example a solid, thin and flexible film. This supporting layer can be either an intermediary support, the laminated assembly being then secured to an article, or the article itself.

However some difficulties are met during the manufacturing of such a laminated assembly because the loops have a tendency to also adhere to the supporting layer through the meshes, together with the base material. This destroys their self-gripping ability since the apex of the loops is firmly laid flat against the base and/or the supporting layer and therefore cannot engage the male elements in the desired hooking relationship. As a matter of fact, to effect this lamination, it is generally necessary to firmly press the two assembly members one against another, for example, by means of calenders.

SUMMARY OF THE INVENTION

The object of the invention is to remedy this shortcoming by providing an adhering method which allows, in a reliable, simple and cheap manner, adherence of the first layer, or supporting layer, to the second layer without the loops being contacted by the binding agent.

To this effect, the method according to the invention includes the step of depositing and adhering a thin adhesive film onto the first face of the second layer under controlled adhesive quantity and viscosity conditions so that the deposited film divides by itself to clear the mesh zones and to be converted into longitudinal and/or transversal beads.

So, in the method according to the invention, on one hand the adhesive is deposited on the second layer, i.e. not on the first layer, and on another hand it is deposited in such a manner that the adhesive web or film, initially deposited in a continuous and solid form, divides or separates by itself, by surface tension effect, to clear the mesh zones so that the adhesive is retained by capillarity only on at least a part of the structural elements of the second layer base, which are generally yarns. The second layer is usually constituted by a looped fabric which is knitted or woven.

Advantageously the first face of the second layer is upwardly directed, for instance, as being horizontal or inclined, for the adhesive file deposit.

BRIEF DESCRIPTION OF THE DRAWINGS

Some of the objects of the invention have been set forth above. Other objects and advantages of the invention will appear as the invention proceeds when taken in conjunction with the following drawings, in which FIG. 1 which belongs to the disclosure is a schematic transverse cross-section view illustrating the processing of the method according to the invention.

DESCRIPTION OF THE PREFERRED EMBODIMENT AND BEST MODE

Figure 1:
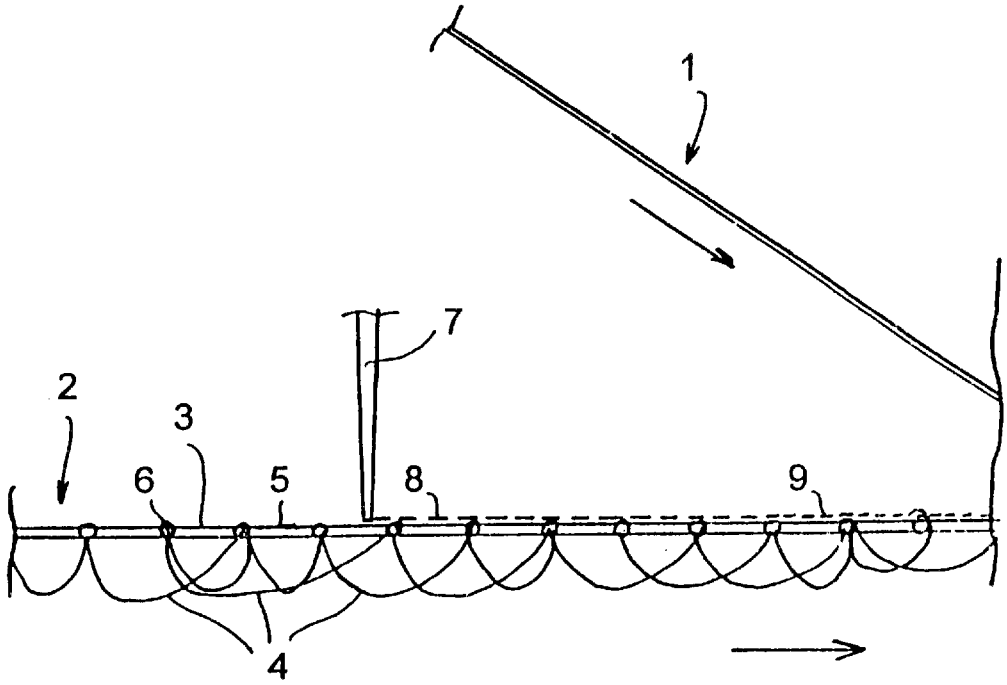

Referring now specifically to the drawings, FIG. 1 shows a laminated assembly, for instance, immediately before the adhering step itself, the two constituting layers of this laminated assembly being therefore shown spaced apart. This assembly comprises a first support layer 1 and a second operative layer 2 which comprises a foundation or base 3 and loops 4 projecting from one of the faces of the base 3.

The first support or reinforcing layer 1 is, for instance, formed by a thin flexible film, for instance, of polypropylene. The base 3 of the second layer 2 has a light and open meshed structure, and it is formed by knitting or woving interleaving of longitudinal yarns 5 (warp or wale yarns) and of transversal yarns 6 (weft yarns). The loops 4 are formed during the manufacturing of the base 3.

The structural elements of the base 3, that is, the yarns 5 and 6 in the example, define relatively large meshes due to the open or apertured structure of the base 3, as mentioned above. For example, these meshes can have a dimension or size of 0.5 mm to 3 mm.

Adhering layers 1 and 2 occurs by means of an adhesive which, according to the invention, is deposited on that face of the base 3 which is remote from or opposite to the face carrying the loops 4. The adhesive is deposited from a nozzle 7 or the like which extends transversely to and just above the moving layer 2. For this adhesive deposit, the layer 2 is in horizontal or inclined position, and its adhesive-receiving face is upwardly directed.

The adhesive is deposited on the base 3 initially in the form of a continuous and solid film 8. The operating conditions are carefully controlled and predetermined as to the adhesive quantity and viscosity. The adhesive is generally a thermofusible adhesive, so that after its deposit the film 8 divides, disaggregates or dislocates by itself to be converted into longitudinal and/or transverse beads corresponding to yarns 5 and 6, respectively. This division, disaggregration or dislocation results from surface tension and capillarity phenomena. In the free or clear zones of the meshes of the base 3, the adhesive bridges between the yarns have a tendency to become thinner and to break down, so that the adhesive concentrates by capillarity only on the structural elements of the base 3, i.e. the yarns 5 and 6, to form longitudinal and/or transverse adhesive beads which define, for example, a network, a lattice or a grid, as schematically shown at 9 in dotted line. Depending on the denier of the yarns 5 and 6, the adhesive concentrates on the warp yarns 5 or on the weft yarns 6, or yet on these two yarn types.

In the example, the two layers 1 and 2 are passed immediately after the adhesive deposit to calendering station in which the layers are pressed against one another. The adhesive beads, which are at the upper part of the base 3, cause the two layers to bond together.

During calendering, due to the fact that the operative adhesive is located in a metered amount only on the structural elements of the base 3 and opposite to the loops 4, the adhesive cannot interfere with the loops 4, so that the loops 4 remain free and clear, i.e. they are not adhered, and that their hooking ability therefore remains intact.

Because the loops are not affected by the adhering, it is possible to reduce, for example by 50%, the denier of the layer 2 without also decreasing the loop hooking ability. This results in an advantageous decrease of the manufacturing costs.

In a practical embodiment example, the following conditions were applied:

Film 1—polypropylene,

Adhesive—a polyurethane-based thermofusible adhesive;

Nozzle 7—transverse with a 0.4 mm opening width;

Fabric 2—polyester or polyamide knitted fabric having a mesh opening of 1.5 mm and a weight of 20 g/m$^2$;

Adhesive Application Amount—2 g/m$^2$, without observing any adhering of the loops 4.

Of course, the invention is not limited to the processing mode which has been described. It is on the contrary possible to conceive various alternatives without departing from its scope as defined by the appended claims. For example, the adhering step itself could be carried out later, at the location of the manufacturing of the article itself. In that case the support layer 1 can be the article itself. As to the adhesive carried by the layer 2, use is made either of an adhesive which can be reactivated after drying and hardening, or, for the winding of the layer 2 to form a roll, of a removable film for protecting the adhesive which remains operative. Alternately an anti-adherent agent coating can be applied on the loops to render the adhesive inoperative with respect to the loops.

A method for manufacturing a laminated assembly including a layer with loops is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A method for manufacturing a laminated assembly having a first layer having a face secured by an adhesive to a first face of a second layer having a meshed structure and having loops projecting from its second face, including the steps of depositing and adhering a thin adhesive film onto the first face of the second layer under controlled adhesive quantity and viscosity conditions so that the deposited film divides by itself to clear mesh zones of the meshed structure and to be concerted into longitudinal and/or transverse beads, wherein the depositing step includes directly depositing the adhesive by a nozzle on the second layer in the form of an initially continuous film.

2. A method according to claim 1, and comprising the step of including in the second layer a looped fabric belonging to the group consisting of knitted fabrics and woven fabrics.

3. A method according to claim 1, and comprising the step of providing the meshed structure with meshes of a size of 0.5 mm to 3 mm.

4. A method according to claim 1, wherein the depositing step includes orienting the second layer first face in an upwardly direction, its direction belonging to the group consisting of a horizontal direction and inclined directions.

5. A method according to claim 1, wherein the adhering step comprises adhering the adhesive film immediately after the adhesive deposit.

6. A method according to claim 1, and comprising reactivating the adhesive film after drying or hardening to adhere the adhesive film at a later stage.

7. A method according to claim 1, and comprising protecting the adhesive film with a removable film such that the adhesive film can be adhered at a later stage.

8. A method according to claim 1, and comprising rendering the adhesive inoperative with respect to the loops to avoid adhesion such that the adhering step can be carried out at a later stage.

9. A method according to claim 8, and comprising coating the loops with an anti-adherent agent.

* * * * *

UNITED STATES PATENT AND TRADEMARK OFFICE
Certificate

Patent No. 5,876,532 Patented: March 2, 1999

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of the patent is: Jean-Pierre Ducauchuis.

Signed and Sealed this Thirteenth Day of March, 2001.

MICHAEL W. BALL
*Supervisory Patent Examiner*
Art Unit 1733

UNITED STATES PATENT AND TRADEMARK OFFICE

CERTIFICATE OF CORRECTION

PATENT NO. : 5,876,532
DATED : March 2, 1999
INVENTOR(S) : Jean-Pierre Billarant It is certified that error appears in the above-identified patent and that said Letters Patent is hereby corrected as shown below:

Title page,
Should be amended to read:

Foreign Application Priority Data

July 3, 1996 France .....96 08259

Signed and Sealed this

Fifth Day of February, 2002

*Attest:*

*Attesting Officer*

JAMES E. ROGAN
*Director of the United States Patent and Trademark Office*